United States Patent [19]

Upperton

[11] 4,346,805

[45] Aug. 31, 1982

[54] CONTAINER

[75] Inventor: Paul H. Upperton, Shoreham-by-Sea, England

[73] Assignee: GPG International Limited, Warwickshire, England

[21] Appl. No.: 188,579

[22] Filed: Sep. 18, 1980

[30] Foreign Application Priority Data

Oct. 30, 1979 [GB] United Kingdom ..... 7937534

[51] Int. Cl.[3] ..... B65D 21/04

[52] U.S. Cl. ..... 206/506; 206/518

[58] Field of Search ..... 206/505, 506, 518

[56] References Cited

U.S. PATENT DOCUMENTS

| | | | |
|---|---|---|---|
| 2,528,551 | 11/1950 | Ross | 206/506 |
| 3,018,003 | 1/1962 | Lockwood | 206/505 |
| 3,404,804 | 10/1968 | Frater | 206/505 |

FOREIGN PATENT DOCUMENTS

| | | | |
|---|---|---|---|
| 1387232 | 12/1964 | France | 206/506 |
| 1472173 | 5/1977 | United Kingdom | 206/506 |

*Primary Examiner*—George E. Lowrance

*Attorney, Agent, or Firm*—McCormick, Paulding & Huber

[57] ABSTRACT

An open-fronted container 1 has a base 2, side walls 3 and a back wall 4 and is capable of supporting an identical overlying container, in column stacking relationship therewith. The container is provided with a pivotable frame member 9', having a generally U-shaped portion and integral cranked legs, for supporting an overhanging cantilevered end of the overlying container.

The frame has an inoperative position 9 in which it can rest on the upper edge of the rear wall and in the rebate defined by integral extension 8, when not supporting an overlying container, and abuts extensions 10 and 11 when in the supporting position.

20 Claims, 6 Drawing Figures

4
17
3
20
18
16
5
6
1
2
9
17
20
18
3
16
5

CONTAINER

TECHNICAL FIELD

This invention relates to a container having an open front for access to the contents carried on a base of the container, and particularly to a container which is intended to be stacked in overlying relationship with a similar container.

BACKGROUND ART

Containers having an open front and an open top are well known, for example, for use in transporting loaves of bread into a supermarket. The containers may be stacked on top of one another in a vertical column to display the loaves and so that access to the loaves carried on the base may be gained through the open front.

Containers of this type have been provided with a rectangular base, two opposed and upstanding side walls, and an upstanding rear wall. The side walls may have upper edges less extensive than the base and sloping front edges to allow greater access to the bread, but if such is the case, the front end of an upper overlying container in a vertical column of such containers tends to overhang the top edges of the side walls of the immediately underlying container. In consequence, the front end of the base of the upper container is cantilevered with the disadvantage that an unstable configuration may be provided to the stack.

It is an object of the present invention to provide means whereby the aforementioned disadvantage may be alleviated and to provide a container having cantilevered portions and which can be stacked with similar containers to provide a stable configuration.

STATEMENT OF INVENTION AND ADVANTAGES

According to the present invention there is provided a container having an open front, the container comprising a base; opposed wall parts generally upstanding from the base and capable of supporting an overlying similar container stacked thereon so that one end of the overlying container is cantilevered and overhangs the underlying container adjacent to the said open front, and wherein the container is provided with support means movable from a first, inoperative position to a second position for supporting the cantilevered end of the overlying container.

The container has an open front, that is to say, the container may be provided with a front wall but at least part of the front wall is cut away for access into the interior of the container. The container may also have an open top. Preferably the container is for vertical column stacking with an overlying similar container and the opposed wall parts may have upper edges remote from the base on which the overlying container can be supported. The upper edges are conveniently less extensive than the base of the container.

The container is preferably provided with a rectangular base, two opposed upstanding side walls and a rear wall.

The container may alternatively have a curved upstanding wall which provides the opposed wall parts (instead of rear and opposed side walls) and which is sufficient to support one end of a similar overlying container in a cantilevered fashion.

The support means may comprise frame means which are slidably mounted on the container to be slidably displaceable from the first inoperative position (where they are preferably unobtrusively located) to the second support position; for example the frame means can comprise rods or bars which are slidably housed in the opposed wall parts to be withdrawable from the first position in to the second position.

More preferably however the support means comprises a frame member pivotally mounted on the container, which is capable of being pivoted into a position for supporting the front end of an overlying container, and preferably before the overlying container is stacked on the underlying container. The support means may be removable from the container completely to facilitate use of the container as a tray. The frame member may be pivotally mounted on the opposed wall parts of the container, and may swing outside the opposed wall parts of the container. The frame member may be pivotally mounted on the upper edges of the opposed wall parts of the container and may swing inside or outside the opposed wall parts.

The opposed wall parts preferably extend longitudinally of the container and the frame member can be connected to the opposed wall parts to be pivotable about a generally transverse axis of the container.

The frame member may be mounted on the container such that it is unobtrusive therefrom in the first, inoperative position; in other words, so that it does not interfere with use of the container as a tray and/or interfere with other containers placed in a side-by-side and/or back-to-back relationship. Where the container is provided with opposed side walls and a rear wall, the frame member may be accommodated at least in part adjacent to the rear wall of the container to be substantially unobtrusive therefrom.

The frame member may comprise a generally U-shaped portion pivotable into a plane which extends substantially perpendicular to the base in the second, support position and which may receive the base of an overlying container. The legs of the U-shaped portion may be connected to the container by integral crank parts to enable the frame member to pivot about the transverse axis. The crank parts may extend longitudinally of the base when the frame member is in the second, support position and may receive the base of an overlying container. Alternatively the bridging part of the frame member may be provided with longitudinal and/or lateral crank portions to receive the overlying base.

The U-shaped portion of the frame member may be inclined to the base in the supporting position and with the bridging part receiving an overlying container.

The arrangement of the frame member is to provide maximum stability for an overlying container, and still be movable to an inoperative position which preferably does not interfere with the nest stacking of two containers nor interfere with the container if it is used as a tray.

The frame member preferably does not extend beyond the lateral dimensions of the other parts of the container.

The frame member may be positioned to pivot about an axis, for example above the base, and near the upper edges of the opposed wall parts. The axis may lie on the upper edges but may nevertheless be lower than the top of the container if the upper edges are suitably shaped; for example, the upper edges may comprise sloping portions.

Stop means may be provided on the container to locate or engage the frame member in the supporting position on abutment therewith. The stop means may be in the form of laterally outward extensions against which the frame member rests in the second, support position. The extensions may be arranged substantially at the level of the base of the container and/or at the front of the container. The crank parts of the frame member may be located or engaged by the stop means, or alternatively the bridging part may abut the stop means which may be in the form of a rebate at the front of the container. The stop means may be located on the underside of the base to be engaged by or for abutment with the frame member of a similar underlying container when the frame member of that container is in the second, support position.

Stop means may also be provided on the container for receiving the support means in the first, inoperative position. The stop means may be in the form of an integral extension defining a rebate around the top of the opposed wall parts of the container, or the upper edges of the wall parts or rear wall may provide the stop means.

The container may be provided with rearward extensions or hooks to latch on to the rear wall of a similar container below it.

FIGURES IN THE DRAWINGS

Embodiments of the invention will now be described in accordance with the invention, by way of example only, with reference to the following drawings, in which.

DETAILED DESCRIPTION OF THE DRAWINGS

Figure 1:
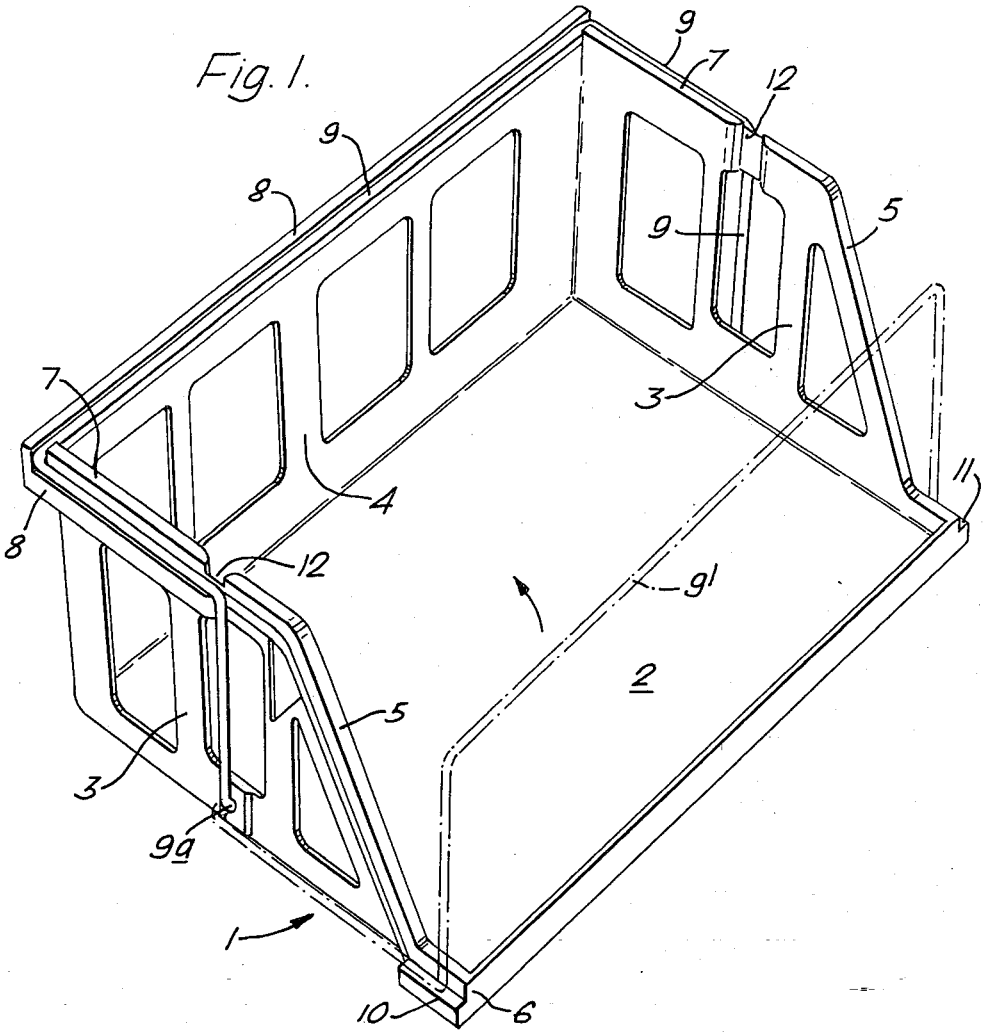
FIG. 1 shows a perspective view of a first embodiment of a container provided with one form of support means.

FIG. 1 shows a container, which may be used for transporting and displaying loaves of bread in vertical column stacking relationship, generally designated by the reference numeral 1 and comprising a rectangular base 2, upstanding from which are opposed side walls 3 and a rear wall 4. The container has an open front and top and the container is of an open framework structure. The front edges 5 of the side walls slope from near the front edge 6 of the base towards the back of the container, and meet upper side-wall edges 7 parallel to the base and on which the base of a similar container may be stacked. The side walls extend longitudinally of the container and, since the front edges slope, the upper edges are less extensive than the base.

The upper edges of the side walls are integral with a lateral and rearward extension 8 defining a rebate together with an upper edge of the rear wall, for the reception of support means, in the form of a frame member shown at 9. The extension 8 provides stop means for the frame member, so that the member can be received in a first, inoperative position. With the frame member in this position the container can be used as a tray for transporting bread from place to place.

As shown in FIG. 1 the frame member comprises a U-shaped portion arranged to lie parallel to the base in the rebate in the inoperative position, and each leg of the U-shape is integral with a crank part extending perpendicularly to the base in this position.

The free ends of the crank parts are pivotally connected at **9*a* to a respective opposed side wall of the container, substantially at the level of the base, so that the frame member is able to pivot about a transverse axis of the container. The frame member can be pivoted into a second position, to support a cantilevered end of an overlying similar container (shown at 9') in which the U-shaped portion of the frame member lies in a plane perpendicular to the base with the bridging part of the U-shaped portion ready to receive the end of the overlying container. In this position the crank parts integral with the U-shaped portion abut stop means in the form of laterally outward extensions 10 and 11. The upper edges of the side walls 7 are provided with nitches 12** to give access to the support member to move it to a supporting position.

Figure 2:
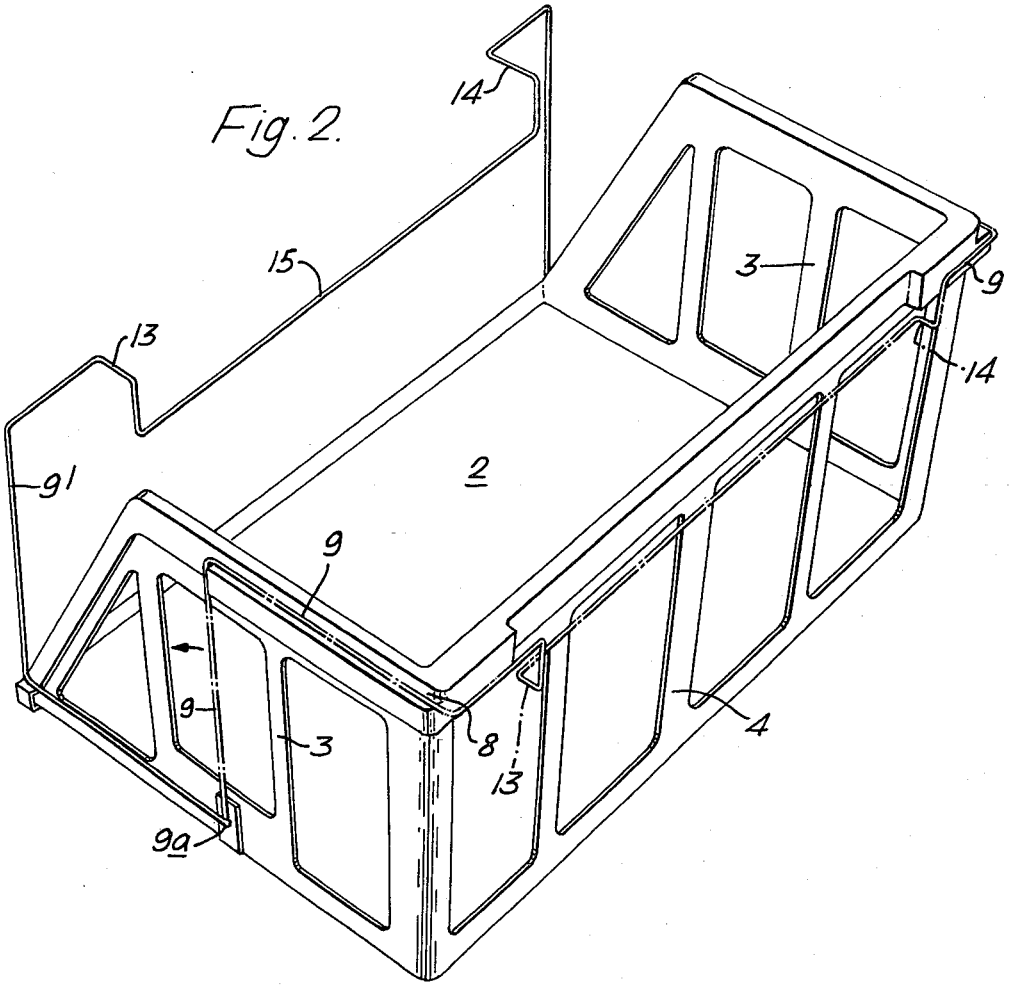
FIG. 2 shows a perspective view of a second embodiment of a container provided with a second form of support means.

FIG. 2 shows a container similar to that of FIG. 1 which is provided with an integral lateral and rearward extension 8 defining a rebate along the upper edges of the opposed side walls for the frame member 9 to lie on (as in FIG. 1), but the frame member 9 extends rearwardly beyond the container when located in the inoperative position. The frame member 9 differs from that shown in FIG. 1 in that, when raised in the support position 9', the bridging part of the generally U-shaped portion is provided with crank support portions 13 and 14, extending longitudinally of the container, integral with a downwardly depending U-shaped portion 15. The portion 15 does not depend downwardly very far, since in the inoperative position shown, most of it must be accommodated within the rearward dimension of extension 8 of the back wall 4 of the container. The pivoting action of the frame member is the same as in FIG. 1. Here, the frame member is accommodated at least in part adjacent to the rear wall of the container to be substantially unobtrusive in the inoperative position.

Figure 3:
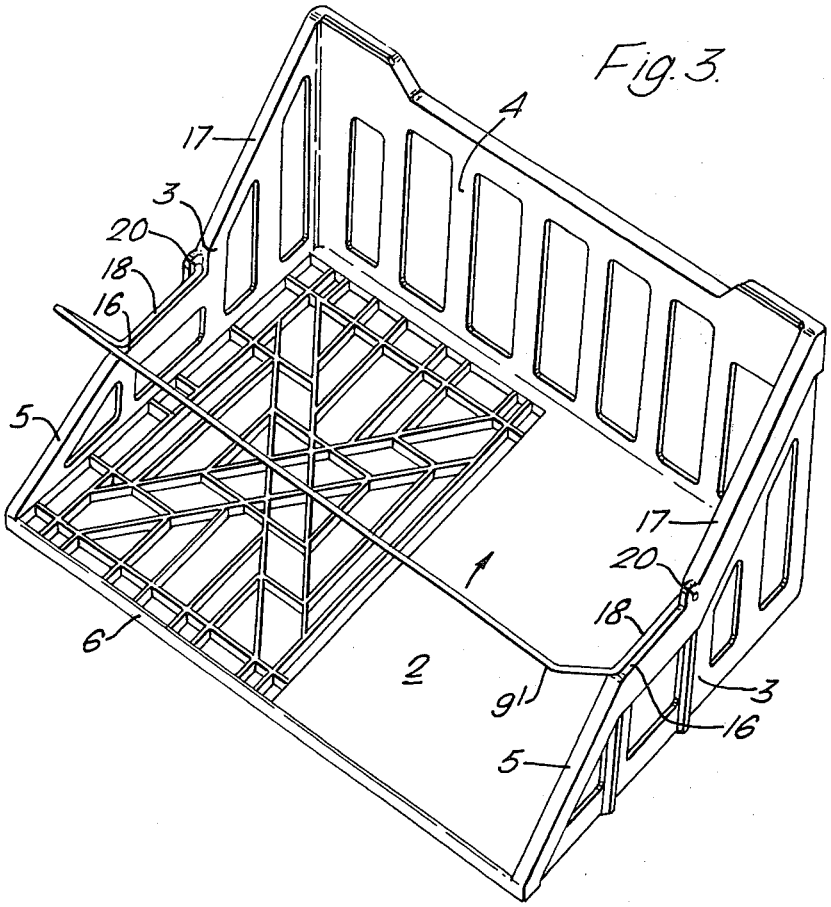
FIG. 3 shows a perspective view of a third embodiment of a container provided with a third form of support means.
Figure 4:
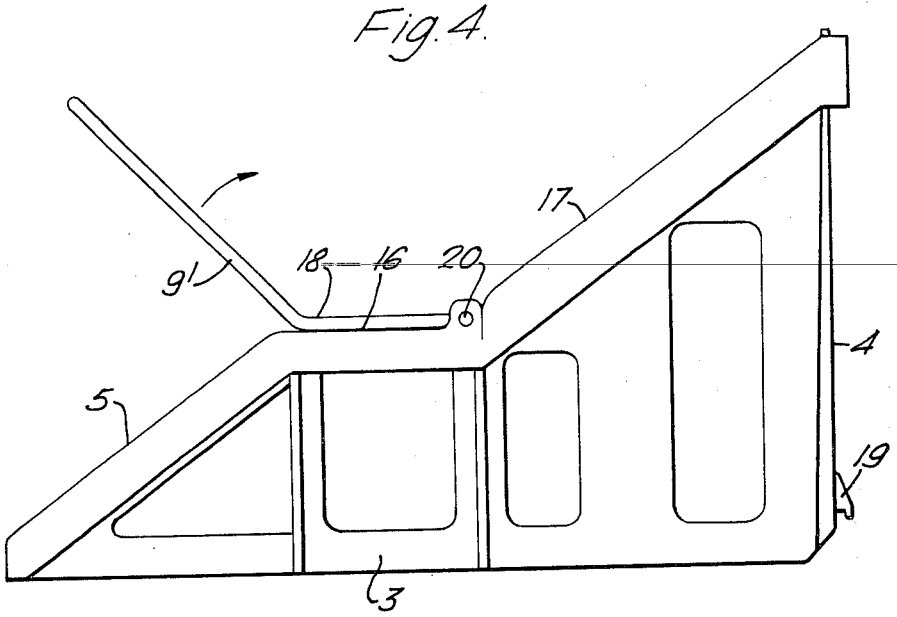
FIG. 4 shows a side view of the embodiment shown in FIG. 3.

FIGS. 3 and 4 show another form of container provided with opposed side walls 3 each having an upper edge portions 16 parallel to the base 2. The front edges 5 slope from the base to meet the upper edge portions 16, and side wall edge portions 17 slope from the top of the back wall 4 to meet the edge portions 16. The frame member is pivotally mounted at 20 on the upper edges of the side walls 16 towards the back of the container and is shown in the support position 9'. Crank parts 18 rest along the upper edges and are integral with a U-shaped frame portion projecting towards the front of the container and upwardly in a manner to support an overlying container. In this embodiment the frame member does not lie outwardly of the main container body. Again the member can be swung into an inoperative position where the U-shaped portion is located on the rear wall of the container.

The frame member does not extend upwardly as high as the wall of the container in the support position as shown in the FIGURE, but the top of the back wall is recessed so that projections 19 can be hooked over the back wall of another container below it and the base of the overlying container may be supported in a plane parallel to the base of the underlying container.

Figure 5:
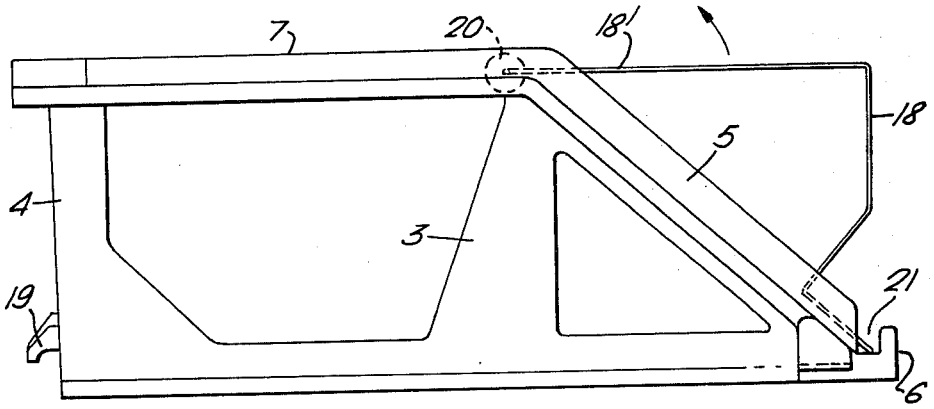
FIG. 5 shows a side view of a fourth embodiment of container provided with a fourth form of support means.

FIG. 5 shows a fourth container in which support means is pivoted about an axis 20 at the top of the container, and when not in a supporting position lies inside the opposed side walls of the container. The support means comprises a pair of similar frame members (one of which is shown at 18) which are pivoted at 20 one on each side wall 3 so that when in the support position as shown they rest in a rebate 21 at the front of the container. In this latter position an overlying container is supported by longitudinally extending crank portions 18' of the two frame members. Each frame member is dog-legged to facilitate positioning of that member relative to the container. Pivotal movement of each frame member 18 from the support position to the inoperative position is in the direction indicated by the arrow.

Figure 6:
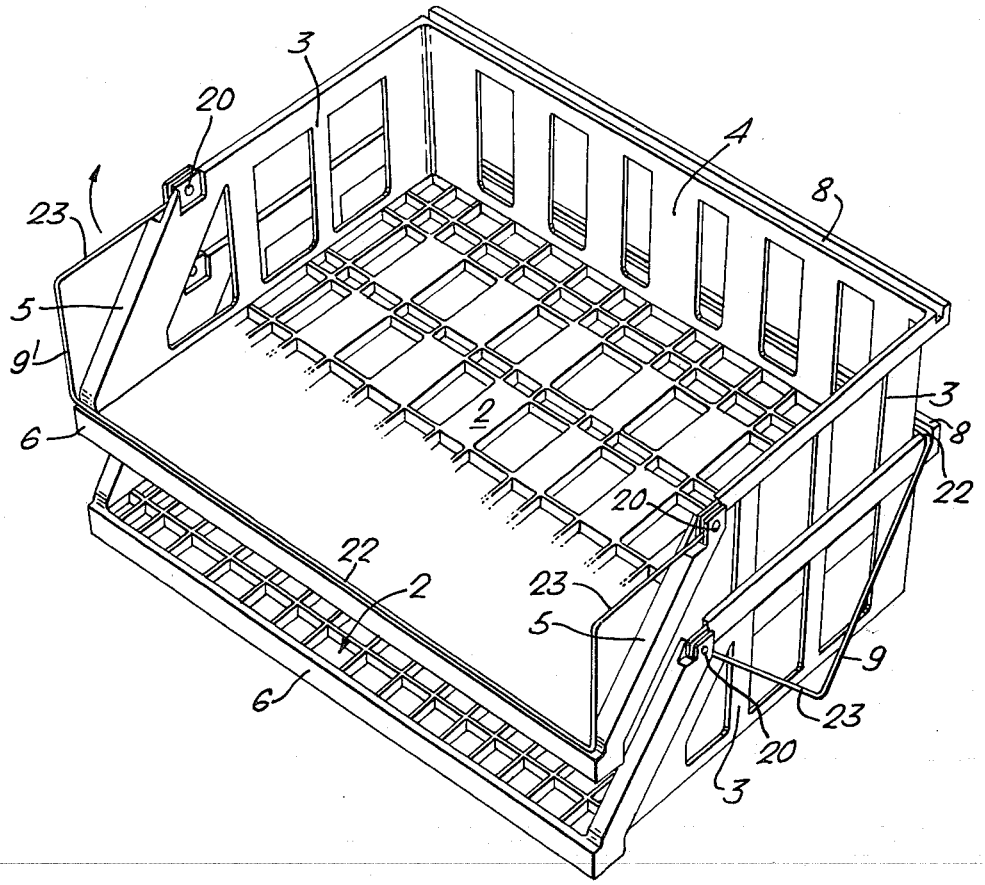
FIG. 6 is a perspective view of a fifth embodiment of container in which two similar containers are nest stacked.

In the embodiment of FIG. 6 the container has a similar support facility to that shown in FIG. 5 except that (a) the support means is in the form of a U-shaped frame member the legs of which are pivoted at 20 to the side walls 3 and which has a support position 9' (shown for the upper of the two nest stacked containers) and an operative position 9 (shown for the lower container), and (b) in the inoperative position of the support means the frame member 9 lies outside the side walls of the container. It will be apparent from FIG. 6 that in its support position 9', the bridging portion 22 of the frame member "U" shape abuts the upper surface of the front edge 6 while the legs of the "U" shape are cranked to provide portions 23 which extend longitudinally to receive and support the cantilevered base portion of a similar overlying container which may be stacked thereon. In its inoperative position 9, the legs of the frame member "U" shape lie closely alongside the respective side walls 3 while the bridging portion 22 is received and supported in the rebate provided by the extension 8 along the upper edge of the rear wall 4—thereby leaving the open top of the container unobtruded to receive a similar container in nest stacking relationship as shown.

All of the embodiments described are such that the frame member is substantially unobtrusive in the first inoperative position.

The scope of the invention extends to any member which may or may not be removable from the container and which may be moved to support the front end of another container in overlying relationship from an inoperative position, before or after the container is stacked on top. The member may be pivoted by any means or may be slidable into a support position. Two or more containers may be used to support a container in particular attitudes, and various stacking permutations may be possible.

I claim:

1. A container for stacking as a vertical column with a similar container which comprises a substantially flat base; wall means upstanding from the base, said wall means comprising opposed forwardly and rearwardly extending side wall parts which together with said base form an open front and an open top which wholly overlie said base; upper edge means for supporting the base of a similar container in vertically stacked overlying relationship, said upper edge means being located on the wall means spaced from and rearwardly of the front of the base, and said side wall parts forwardly of the upper edge means being shaped to permit access to the container from the sides thereof adjacent to its open front, and a pivotally mounted frame member movable from a first, inoperative, position clear of said open front and open top into a second position in which it abuts stop means forwardly of and below said upper edge means, said frame member in its second position providing a support part which extends upwardly from said stop means and with respect to the base to provide support forwardly of the upper edge means to a said overlying container beneath the base of that container adjacent to the front thereof where the base of the overlying container is substantially parallel with the base of the underlying container and will project forwardly in cantilevered manner from the support provided by said upper edge means of the underlying container.

2. A container as claimed in claim 1 in which the upper edge means is located, at least in part, on the opposed side wall parts.

3. A container as claimed in claim 1 in which the base is generally rectangular, and said wall means comprises the opposed upstanding side wall parts and a rear wall.

4. A container as claimed in claim 3 in which the upper edge means is located, at least in part, on said rear wall.

5. A container as claimed in claim 1 in which the base is generally rectangular and provided with the opposed upstanding side wall parts and a rear wall and the frame member in the first, inoperative, position is accommodated at least in part adjacent to the rear wall of the container to be substantially unobtrusive therefrom.

6. A container as claimed in claim 1 in which the frame member is pivotally connected to the opposed side wall parts to be pivotable about a generally transverse axis of the container.

7. A container as claimed in claim 1 in which the frame member comprises a generally U-shaped portion pivotable into a plane in which the support part extends substantially perpendicular to the base in the second support position.

8. A container as claimed in claim 7 in which each leg of the U-shaped portion is integral with a crank part extending substantially longitudinally of the container when the frame member is in the second support position.

9. A container as claimed in claim 1 in which the frame member is pivotally mounted for swinging movement outside the opposed side wall parts.

10. A container as claimed in claim 1 in which the frame member is pivotally mounted about an axis lying above the base of the container.

11. A container as claimed in claim 10 in which the frame member is pivotally mounted about an axis lying substantially level with the upper edge means of the container.

12. A container as claimed in claim 1 in which said stop means comprises at least one of said base and said side wall parts.

13. A container as claimed in claim 12 in which the stop means is located on the underside of the base to be engaged by or for abutment with the frame member of a similar underlying container when the frame member of that container is in the second position.

14. A container as claimed in claim 1 in which the frame member is accommodated adjacent the upstanding side wall parts to be substantially unobtrusive in the first inoperative position.

15. A container as claimed in claim 1 in which the frame member is removable from the container.

16. A container as claimed in claim 1 in which the container is provided with locating means to locate the support means in the first, inoperative position, to facilitate use of the container as a tray.

17. A container as claimed in claim 16 in which the locating means is in the form of an integral extension defining a rebate around the top of the opposed side wall parts of the container.

18. A container as claimed in claim 4 in which the opposed wall parts diverge from each other as they extend upwardly from the base and in its first, inoperative position, said frame member is clear of both the open front and an open top of the container so that two similar containers can be nested one within the other with their bases in substantially parallel and overlying relationship.

19. A container for stacking as a vertical column with a similar container which comprises a substantially flat base; wall means upstanding from the base, said wall means comprising opposed forwardly and rearwardly extending side wall parts which together with said base form an open front which wholly overlies said base; upper edge means for supporting the base of a similar container in vertically stacked overlying relationship, said upper edge means being located on the wall means spaced from and rearwardly of the front of the base and said side wall parts forwardly of the upper edge means being shaped to permit access to the container from the sides thereof adjacent to its open front, and support means in the form of a frame member pivotally mounted on the container and movable from a first, inoperative, position clear of said open front into a second position to provide support to a similar overyling container beneath the base of that container adjacent to the front thereof, the frame member having a generally U-shaped portion pivotable into a plane in which a support part of the member extends substantially perpendicular to the base in the second support position, and a bridging part of the generally U-shaped portion includes at least one crank portion which, with the frame member in the second support position, extends forwardly and rearwardly of the container in a plane parallel to the base for receiving the base of an overlying container, whereby the base of the overlying container may project forwardly in a cantilever manner from the support provided by said upper edge means of the underlying container.

20. A container as claimed in claim 19 in which the crank parts extend in a plane parallel to the base of the container for receiving the base of an overlying container.

* * * * *